United States Patent [19]

Jordan, Sr.

[11] 4,241,744

[45] Dec. 30, 1980

[54] CLEANING SYSTEM FOR TANKS

[76] Inventor: Nathaniel Jordan, Sr., 1266 Springwood Cir., Winston-Salem, N.C. 27107

[21] Appl. No.: 54,036

[22] Filed: Jul. 2, 1979

[51] Int. Cl.[3] ..... B08B 9/08

[52] U.S. Cl. ..... 134/168 R; 134/175; 239/124

[58] Field of Search ..... 134/22 R, 143, 166 R–169 R, 134/172, 175, 177, 198–199; 239/110, 124, 567

[56] References Cited

U.S. PATENT DOCUMENTS

| | | | |
|---|---|---|---|
| 709,907 | 9/1902 | Huebner | 239/567 X |
| 1,260,947 | 3/1918 | Sperry et al. | 134/167 R |
| 1,655,859 | 1/1928 | Engbrecht | 134/24 X |
| 2,721,566 | 10/1955 | Brucker | 134/177 X |
| 3,104,672 | 9/1963 | Holdren | 134/168 R |
| 3,236,249 | 2/1966 | Everroad | 134/167 R |
| 3,256,800 | 6/1966 | Halldorsson | 134/198 X |
| 3,630,777 | 12/1971 | Ishizawa et al. | 134/169 R X |
| 3,798,066 | 3/1974 | Evans | 134/166 R X |
| 3,802,447 | 4/1974 | Bender | 134/168 R X |
| 4,140,543 | 2/1979 | Soleri et al. | 134/22 R |

*Primary Examiner*—Robert L. Bleutge
*Attorney, Agent, or Firm*—William S. Burden

[57] ABSTRACT

An improved cleaning system for removing residue from the inside walls of a tank by directing a cleaning solvent flow completely over the tank inner walls at a controlled, minimum pressure. The cleaning solvent is directed through a ring assembly, which equalizes the flow of cleaning fluid through a series of equally spaced openings around the outer periphery of the ring assembly, and is supported such that the openings direct the fluid onto the uppermost surfaces of the tank interior wall. The ring assembly includes a series of releasably secured components and a valve for regulating the fluid flow rate through the openings.

8 Claims, 4 Drawing Figures

CLEANING SYSTEM FOR TANKS

BACKGROUND, BRIEF SUMMARY AND OBJECTS OF THE INVENTION

This invention relates generally to a cleaning system, and more particularly to a new and improved system for cleaning the internal vertical wall surfaces of tanks or other receptacles by providing a continuous, even flow of cleaning liquid or solvent to the interior walls to remove undesirable residues after such tanks have been used for mixing various products such as inks, paints, etc.

Various systems have been previously developed for emptying and/or cleaning tanks or drums as disclosed, for example, by U.S. Pat. Nos. 4,140,543; 3,802,447; 3,630,777; and 3,798,066. U.S. Pat. Nos. 4,140,543; 3,802,447, and 3,798,066 disclose cleaning of tanks which includes pressure spraying. U.S. Pat. No. 3,630,777 discloses the ejection of a cleaning liquid from a pipe towards the inside wall surface of a tank, and the fluid is discharged from the tank by a transfer pump 6.

The present invention involves continuously recirculating a cleaning fluid from the tank, through a filter, pump and ring assembly where it is again directed, with a smooth, even, minimum pressure from a plurality of equally spaced and downwardly angled openings positioned in close proximity to the uppermost interior surfaces of the tank wall to provide a flow that substantially completely covers the inner surfaces of the wall. The ring assembly is supported in the desired position relative to the side wall by brackets or a cover member which encompasses the upper, open end of the tank.

The ring assembly includes a series of conduit components which are releasable to facilitate cleaning of the assembly, and the assembly also includes a valve for controlling and regulating the rate of fluid flow to prevent spraying and/or splashing of the cleaning fluid onto the tank side wall.

One of the primary objects of the invention is the provision of a new and improved system for effectively and efficiently removing undesirable residue from the side walls of tanks.

Another object of the invention is the provision of a cleaning system which effectively cleans with minimum pressure while also eliminating excessive vapors.

Still another object of the invention is the provision of a system for reducing the tank cleaning time as well as the spray or mist effect as the fluid is directed from the openings onto the side wall.

A further object of the invention is the provision of apparatus for regulating fluid discharge from the openings.

Other objects and advantages of the invention will become apparent when considered in view of the following detailed description.

DETAILED DESCRIPTION OF THE INVENTION

While the cleaning system of the present invention is particularly applicable to the washing and cleaning of the interior walls of ink and paint tanks by recirculating cleaning solvents over the walls, the invention also may be applicable to the cleaning of a variety of products from the inner, vertical walls of drums, tanks and other vessels.

Figure 1:
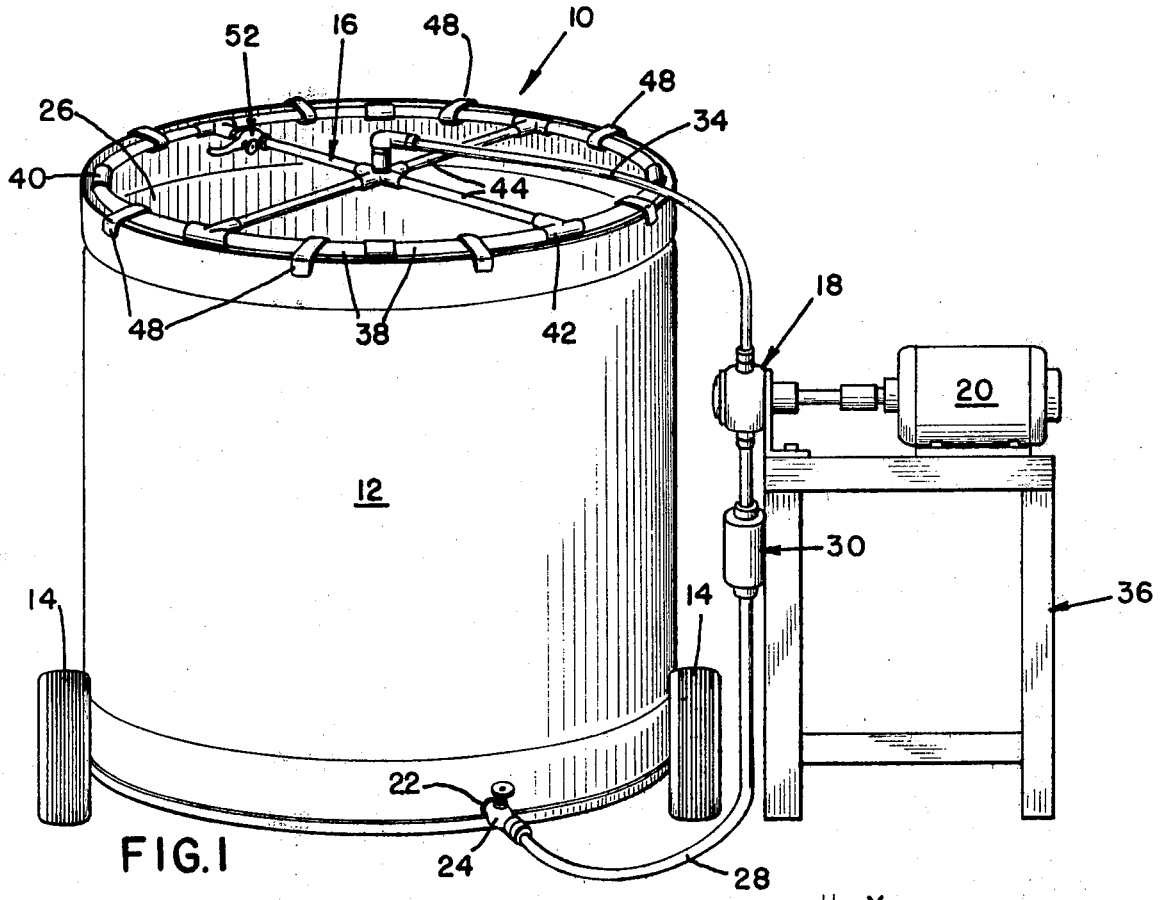
FIG. 1 is a schematic, perspective view illustrating features of the apparatus embodying the invention.
Figure 2:
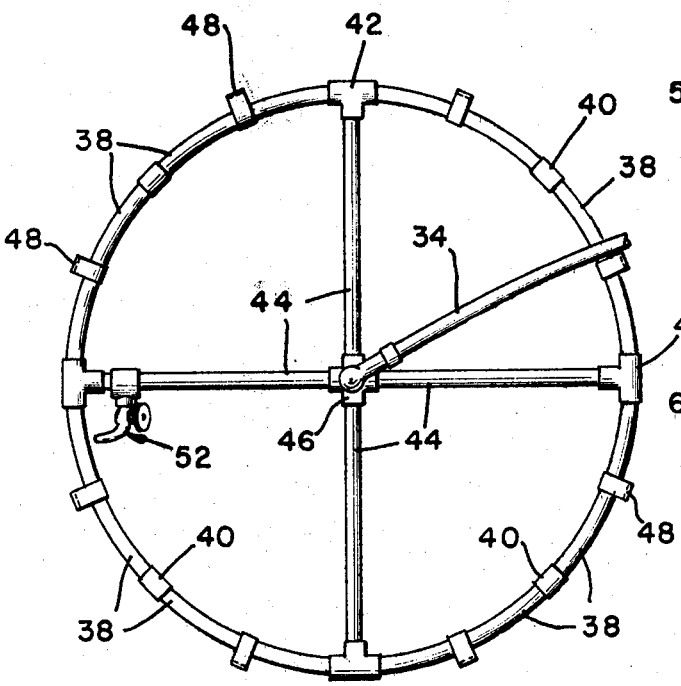
FIG. 2 is a schematic, top plan view of the fluid discharge ring and ring supports of FIG. 1 through which cleaning fluid is directed against the inner side wall of a vertical tank or vat.

Referring particularly to FIGS. 1 and 2, reference numeral 10 refers to the overall cleaning apparatus which includes a vertical tank 12 supported by wheels 14, a cleaning fluid discharge ring assembly 16 supported at the upper open end of the tank 12 and a pump 18, driven by motor 20, for circulating cleaning fluid through the tank.

The tank 12 may be used in the manufacturing of various products, and preferably is of a size for receiving various quantities of resins, solvents, powders, etc., for example, which are used in preparing and mixing large quantities of ink. While sizes may vary, the tanks may be sufficiently large to mix and/or store approximately 275–550 gallons of ink therein. A discharge outlet 22 having a valve 24 is located at the bottom of the tank 12 for removing inks or other products that have been mixed in the tank.

Upon removal of the ink from the tank, the tank must be cleaned to remove completely any ink residue remaining on the interior side walls 26 prior to mixing additional quantities of ink therein.

It has been a common practice to clean tanks manually or to direct a solvent under pressure against the tank side wall.

In the present invention a selected quantity, depending upon tank size, of a suitable cleaning solvent is continuously recirculated through a flexible conduit 28, a filter 30, the pump 18, a flexible conduit 34 and the discharge ring assembly 16 to provide a steady even flow rate completely around and down the entire inner wall for effectively, efficiently and completely cleaning the inside of the tank. The pump 18 is driven at a selected speed by the motor 20 to provide an even flow of cleaning fluid to the ring assembly 16 at a minimum pressure. As shown, the pump 18, motor 20, and filter 30 may be mounted upon a suitable support 36.

Referring to FIG. 2, the ring assembly 16 includes a series of arcuate pipe sections 38 interconnected by union couplings 40 and T-couplings 42 to define a ring-like member. A series of pipe sections 44 are connected to the T-couplings 42 and are directed radially inwardly from the ring to a common junction 46 which, in turn, is connected to the flexible conduit 34. While the pipe sections 38 and 44 may be formed of various selected sizes and materials, preferably they are formed of material having sufficient rigidity and strength to define a ring having the unity to be supported upon the tank top rim by brackets 48 secured at selected intervals around the ring to the pipe sections 38. In a specific example, the conduits 38 and 44 may have an internal diameter of approximately one-half inch, and the conduit 34 may have an internal diameter of approximately one inch.

The couplings 40, 42 provide a knock-down type construction which permits the ring assembly to be readily disassembled for cleaning of the various conduit sections.

Figure 3:
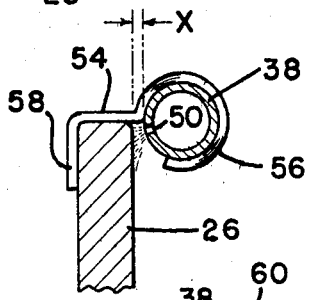
FIG. 3 is an enlarged, fragmentary, sectional view of the discharge ring and vessel side wall and illustrating one type of bracket for supporting the ring relative to the side wall.
Figure 4:
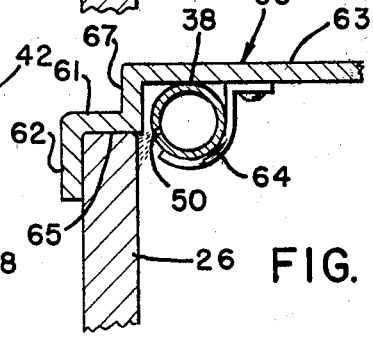
FIG. 4 is an enlarged, fragmentary, sectional view of the discharge ring and tank side wall, and illustrating a ring support bracket mounted upon a cover plate or cap for the tank.

The conduit sections 38 are provided with a plurality of small, equally spaced openings 50, FIGS. 3 and 4, which are directed downwardly and outwardly toward the tank inner wall 26 at a selected angle for conveying cleaning fluid against the uppermost portions of the inner wall while eliminating splashing or high pressure spraying of the fluid onto the wall. The opening size and the spacing between adjacent openings 50 may vary depending upon tank size, desired flow rate, etc. However, for a specified tank size, the openings should be spaced at a constant interval and sufficiently close to each other to provide a complete fluid flow covering the entire inner wall 26. In a specific embodiment, the openings 50 may be spaced apart approximately two inches and have a diameter of three-sixteenths of an inch. Normally, the outer peripheral portions of conduit segments 38 are positioned a distance X, FIG. 3, of approximately one-half inch from the inner periphery of the side wall 26.

The pump 18, driven by motor 20, preferably directs the fluid at a predetermined flow rate from the openings 50 with minimum splash, spray and mist while at the same time providing an even cover of the side wall 26 as the fluid flows downwardly. The cleaning fluid flow rate through opening 50 can be regulated by means of the valve 52 communicating with one of the pipe sections 44. The valve 52 is located sufficiently close to the side wall 26, as shown by FIG. 2, with the discharge outlet angled downwardly and outwardly towards the inner periphery of side wall 26, such that any fluid flowing therethrough also is directed against the side wall with minimum splash. As fluid flows down the side wall 26 it collects at the bottom of tank 12 and is continuously circulated through valve 24, conduit 28, filter 30, pump 18 and back through the ring assembly 16. Directing the fluid through the flexible conduit 34 to the center of the ring assembly 16 and through a series of radiating conduit sections 44 provides an even, substantially constant fluid discharge through all openings 50.

FIG. 3 illustrates a modified embodiment of a ring support bracket 54 which positions the discharge openings 50 adjacent the uppermost, inner portions of side wall 26, thus cleaning substantially the entire inner portions of wall 26. The brackets 54 are suitably secured to the arcuate pipe sections 38 at selected intervals, and each includes a first portion 56 which extends partially around the pipe section 38, and a portion 58 for hooking over the tank wall 26 and retaining the ring assembly 16 in position.

FIG. 4 illustrates still another system for supporting the ring assembly at a desired position for effectively cleaning substantially the entire inner surface area of the wall 26. In FIG. 4, a cap or cover member 60, which completely covers and seals the open upper end of the tank 12, has a configuration for positioning the openings 50 for directing cleaning fluid onto the uppermost portions of the side wall. The cover 60 includes a disk portion 63 and a peripheral portion 61. The peripheral portion 61 rests upon the upper edge 65 of the side wall 26 and includes a portion 67 for vertically spacing the disk portion 63 above the wall 26, and a lip portion 62 for retaining the cover 60 in position. The cover 60 serves to substantially eliminate cleaning fluid vapors and/or mist effect during the cleaning operation. A series of jackets 64 and suitable fasteners releasably secure the ring assembly 16 to the disk portion 63 of the cover.

After material such as ink, for example, has been prepared within the tank 12, and subsequently discharged through the valve 24, the residue remaining in the tank must be thoroughly removed prior to mixing additional ink within the tank.

In the operation of the tank cleaning system of the present invention, an operator positions the ring assembly 16 upon the tank, as shown by FIG. 1, and connects the pump 18 to the tank through conduit 28 and to the ring assembly 16, through the conduit 34. A predetermined quantity of a suitable cleaning solvent, for example eighteen gallons, is placed in the tank 12 and the pump 18 activated by motor 20 to pump the fluid through valve 24, conduits 28, 34 and ring assembly 16 continuously for a selected time period until the tank is clean. The openings 50 are in close proximity to the inner, uppermost edge of wall 26 and angled to provide an even flow completely over the wall inner portions. The cleaning fluid is directed against the wall 26 with minimum pressure, with the flow rate through openings 50 being controlled by the valve 52. When the side wall is clean, conduit 28 is disconnected from the valve 24 and the cleaning fluid is discharged from the tank 12. The tank also may be rinsed in a similar manner, if desired, by placing additional cleaning fluid in the tank and recirculating the fluid, as previously described.

The present system provides for the rapid and effective cleaning of residue from within the tank in a relatively short time compared with manual cleaning of the tank. Fumes from the cleaning operation can be substantially reduced by utilizing the ring assembly provided with the cover 60.

What is claimed is:

1. Apparatus for cleaning residue from the internal surfaces of a vertical side wall of a tank having an upper open end and a discharge valve at the lower end thereof by circulating a cleaning fluid substantially completely over the entire internal surfaces at a controlled minimum pressure to prevent spraying of the surfaces, comprising; a ring assembly, said ring assembly including an arcuate ring-like means defining a series of openings therein, fluid inlet means located centrally of said arcuate ring-like means, and distribution means for directing cleaning fluid radially from said inlet means to said ring-like means, means for supplying cleaning fluid to said fluid inlet means at a selected low pressure for distribution to said ring-like means for substantially equal, even discharge through each opening of said series of openings against the side wall uppermost inner surfaces for flow downwardly of the internal surfaces of the tank side wall, support means secured to said ring-like means for support by the upper open end of the tank for positioning said ring-like means parallel with and in close proximity to the internal surfaces of the tank vertical side wall and with said series of openings in close proximity to the side wall vertical surfaces and adjacent the uppermost internal surfaces of the wall for directing an even flow of cleaning fluid onto the side wall to provide a complete fluid flow downwardly over substantially the entire internal surfaces of the side wall, said ring assembly further including means for adjustably controlling the flow rate of cleaning fluid through said series of openings.

2. Apparatus as recited in claim 1, wherein said means for supplying cleaning fluid to said fluid inlet means includes a pump, and conduit means coupling said pump to the tank discharge valve for continuously circulating cleaning fluid over the side wall internal surfaces.

3. Apparatus as recited in claim 1, said distribution means including a plurality of conduit sections releasably coupled to said fluid inlet means and said arcuate conduit sections and extending radially inwardly of said ring-like means, said means for controlling the flow rate of cleaning fluid through said series of openings including discharge valve means coupled to one of said plurality of radially extending conduit sections and positioned adjacent said ring-like means for directing fluid flowing therethrough directly onto the tank side wall.

4. Apparatus as recited in claim 1, wherein said arcuate ring-like means includes a plurality of arcuate conduit sections releasably coupled to facilitate cleaning of said ring assembly, and wherein each section of said plurality of arcuate conduit sections forming said ring-like means includes a plurality of said openings therein, said openings being equally spaced around said ring-like means and angled downwardly and outwardly towards the internal surfaces of the tank side wall, said support means including a plurality of brackets secured to said ring assembly, each bracket including a portion for engaging the upper edge portion of the tank side wall and retaining said ring assembly in a selected position with a substantial portion of said arcuate ring-like means positioned above the upper edge portion of the tank side wall and with said series of openings positioned to discharge fluid therethrough for flow downwardly over substantially the entire side wall interior surfaces.

5. Apparatus as recited in claim 1, said support means including means for covering the open, upper end of the tank to reduce fumes and vapors during cleaning of the side wall.

6. Apparatus as recited in claim 1, said support means including cover means for encompassing the open, upper end of the tank to reduce fumes and vapors, said cover means including a disk portion and a peripheral portion resting upon the tank side wall upper edge and maintaining said disk portion in spaced relation above the tank side wall, said support means further including means for releasably securing said ring assembly to said disk portion with said series of openings positioned to direct fluid to the uppermost internal edges of the tank side wall.

7. Portable apparatus for cleaning vertical internal wall surfaces of an open top tank by directing a continuous, smooth, even flow of a cleaning solvent onto the tank uppermost, internal surfaces with minimum pressure for flow downwardly over the entire internal vertical surfaces to remove undesirable residues therefrom comprising; a tubular member selectively supported at the upper end of the tank and defining a series of openings therein, each of said series of openings being directed downwardly and outwardly towards the tank uppermost, internal vertical surfaces for directing a cleaning solvent onto the uppermost, internal tank surfaces, means supporting said tubular member parallel with, in close proximity to, and at least partially above the uppermost end of the tank with said series of openings in close proximity to the tank vertical wall to provide an even flow of solvent substantially completely over the tank vertical internal surfaces in a continuous sheet, solvent inlet means located inwardly of said tubular member, means for supplying solvent to said inlet means, a plurality of hollow distributor members coupling said inlet means to said tubular member, and regulator means on one of said distributor members adjacent said tubular member for selectively controlling the pressure and flow rate of cleaning solvent through said series of openings.

8. Portable apparatus as recited in claim 7, said means supporting said tubular member including cover means for encompassing the open, upper end of the tank to reduce fumes and vapors, said cover means including a disk portion and a spacer portion for positioning said disk portion from the tank upper end, and means releasably securing said tubular member to said disk portion.

* * * * *